US009620041B2

(12) United States Patent
Liu

(10) Patent No.: US 9,620,041 B2
(45) Date of Patent: Apr. 11, 2017

(54) DRIVING METHOD AND DISPLAY USING THE DRIVING METHOD

(71) Applicant: Hung-Ta Liu, Hsinchu County (TW)

(72) Inventor: Hung-Ta Liu, Hsinchu County (TW)

( * ) Notice: Subject to any disclaimer, the term of this patent is extended or adjusted under 35 U.S.C. 154(b) by 135 days.

(21) Appl. No.: 13/742,369

(22) Filed: Jan. 16, 2013

(65) Prior Publication Data

US 2013/0187897 A1 Jul. 25, 2013

(30) Foreign Application Priority Data

Jan. 20, 2012 (TW) ..... 101102566 A

(51) Int. Cl.

| | |
|---|---|
| ***G09G 3/00*** | (2006.01) |
| ***G09G 3/36*** | (2006.01) |
| *G09G 5/14* | (2006.01) |

(52) U.S. Cl.

CPC ..... *G09G 3/00* (2013.01); *G09G 3/3648* (2013.01); *G09G 3/3685* (2013.01); *G09G 5/14* (2013.01); *G09G 2310/0213* (2013.01); *G09G 2320/103* (2013.01); *G09G 2340/0435* (2013.01)

(58) Field of Classification Search

CPC ..... G09G 3/36; G09G 3/3611; G09G 3/3648–3/3666; G09G 2320/10–2320/106; G09G 2340/04–2340/0435

USPC ..... 345/204, 690–693

See application file for complete search history.

(56) References Cited

U.S. PATENT DOCUMENTS

| | | | | |
|---|---|---|---|---|
| 6,466,193 | B1 | 10/2002 | Anai | |
| 6,989,823 | B1 * | 1/2006 | Lasneski | 345/204 |
| 2001/0017611 | A1 | 8/2001 | Moriyama | |
| 2002/0180673 | A1 * | 12/2002 | Tsuda et al. | 345/87 |
| 2004/0047530 | A1 | 3/2004 | Hara et al. | |
| 2008/0143728 | A1 * | 6/2008 | Gorla et al. | 345/501 |
| 2008/0158117 | A1 * | 7/2008 | Wong | G09G 3/20 345/87 |
| 2010/0231800 | A1 * | 9/2010 | White et al. | 348/663 |
| 2011/0012907 | A1 * | 1/2011 | Sakamoto et al. | 345/555 |
| 2011/0032231 | A1 | 2/2011 | Maruyama et al. | |
| 2011/0057914 | A1 * | 3/2011 | Nam | G09G 3/3648 345/211 |
| 2011/0074800 | A1 * | 3/2011 | Stevens et al. | 345/545 |
| 2011/0085635 | A1 | 4/2011 | Koyama | |

(Continued)

FOREIGN PATENT DOCUMENTS

| | | | |
|---|---|---|---|
| CN | 1440514 | A | 9/2003 |
| CN | 101751873 | A | 6/2010 |

(Continued)

*Primary Examiner* — Nathan Danielsen

(74) *Attorney, Agent, or Firm* — CKC & Partners Co., Ltd.

(57) ABSTRACT

A driving method drives a display. The display includes a scan driving circuit, a data driving circuit, a plurality of first signal lines coupling with the scan driving circuit, and a plurality of second signal lines coupling with the data driving circuit. The first signal lines cross the second signal lines to form the pixel matrix. The driving method comprises to divide the pixel matrix into at least a first region and a second region, then, to drive the first region by a first frame rate, and to drive the second region by a second frame rate, wherein the first frame rate is leas than the second frame rate.

11 Claims, 7 Drawing Sheets

(56) References Cited

U.S. PATENT DOCUMENTS

| | | | | |
|---|---|---|---|---|
| 2011/0199404 | A1* | 8/2011 | Umezaki | G09G 3/3648 345/691 |
| 2012/0162238 | A1* | 6/2012 | Fleck et al. | 345/545 |

FOREIGN PATENT DOCUMENTS

| | | | |
|---|---|---|---|
| CN | 102024432 | A | 4/2011 |
| JP | H095789 | A | 1/1997 |
| JP | H09331490 | A | 12/1997 |
| JP | 2000267066 | A | 9/2000 |
| JP | 2004-062163 | A | 2/2004 |
| JP | 2006301655 | A | 11/2006 |
| JP | 2007214659 | A | 8/2007 |
| JP | 2008033362 | A | 2/2008 |
| JP | 2008310266 | A | 12/2008 |
| JP | 2011039081 | A | 2/2011 |
| JP | 2011141539 | A | 7/2011 |
| KR | 20080040900 | A | 5/2008 |
| KR | 20110066504 | A | 6/2011 |
| KR | 20110123468 | A | 11/2011 |
| KR | 10-2013-0005807 | A | 1/2013 |
| TW | 201133459 | A | 10/2011 |

* cited by examiner

DRIVING METHOD AND DISPLAY USING THE DRIVING METHOD

RELATED APPLICATIONS

This application claims priority to Taiwan Application Serial Number 101102566, filed Jan. 20, 2012, which is herein incorporated by reference.

TECHNICAL FIELD

The present disclosure relates to a driving method, and more particularly to a driving method and a display structure using the driving method.

BACKGROUND

In a thin film transistor liquid crystal display, an image is displayed by changing the voltage applied to the pixels to vary the field applied to the liquid crystal to control the twisted angle or arrangement of the liquid crystal molecule, thereby to control the luminous flux amount.

FIG. 1 illustrates a schematic diagram of a typical thin film transistor liquid crystal display. The thin film transistor liquid crystal display 100 includes a scan driving circuit 101, a data driving circuit 102, a plurality of scan lines 1021-102*m*, a plurality of data lines 1011~101*n* and a plurality of thin film transistors 103. The scan lines 1021-102*m* are arranged in parallel. The data lines 1011~101*n* are also arranged in parallel and cross the scan lines 1021-102*m*. The data lines 1011~101*n* are insulated from the scan lines 1021-102*m*. The thin film transistors 103 are located in the positions that the data lines 1011~101*n* crossing the scan lines 1021-102*m*. The gate electrodes of the thin film transistors 103 are coupled to the scan lines 1021-102*m* respectively. The source electrodes of the thin film transistors 103 are coupled to the data lines 1011~101*n* respectively. The drain electrodes of the thin film transistors 103 are coupled to the pixel electrodes 104 respectively.

The top glass substrate includes common electrodes 105 corresponding to the pixel electrodes 104. The material forming the common electrodes 105 is Indium Tin Oxide (ITO). A pixel unit includes a pixel electrode 104, a common electrode 105 and liquid crystal molecules between the pixel electrode 104 and the common electrode 105. A pixel unit is a minimum display unit in a liquid crystal display 100. Typically, a common voltage Vcom is applied to all common electrodes 105 and gray voltages related to the pixel data are applied to corresponding pixel electrodes 104 to generate voltage difference. The liquid crystal molecules between the common electrodes 105 and the pixel electrodes 104 are rotated to special angles by the voltage difference to display gray images.

FIG. 2 illustrates a schematic diagram of a waveform of a signal to drive the thin film transistor liquid crystal display 100. The waveforms G1-Gn are the scan signal waveforms applied to the scan lines 1021-102*m* respectively, The waveform Vcom is the common voltage waveform applied to the common electrode 105. The waveform Vd is the gray voltage waveform applied to the pixel electrodes 104. Referring to FIG. 1 and FIG. 2, the scan driving circuit 101 generates a plurality scan signals, waveforms G1-Gn, to the scan lines 1021-102*m* in a frame. The scan signals G1-Gn are high-level signals. When the scan signals G1-Gn are applied to the scan signals G1-Gn, the thin film transistors are turned on by the high-level scan signals G1-Gn. Then, the data driving circuit 102 transfers gray level voltages to the pixel electrodes 104 through the turned-on thin film transistors 103 to make pixel units to shown an image of the frame.

In the foregoing driving method, the frame rate of the display is 60 Hz or 75 Hz. That is, 60 images or 75 images are continuously shown in the display in a second. However, in a case, some continuous images are static images, that is, these images are same images. In other words, it is not necessary to repeated renew the display in this case. Therefore, such unchangeable frame rate will result in invisible waste.

SUMMARY

The present invention provides a driving method for a display by using different frame rates to drive a static region (or a slow motion region) and a dynamic region to reduce the total power consumption of a display.

The present invention also provides a driving method for a display by reducing the power supplied to the scan driving circuit and data driving circuit to reduce the total power consumption of a display.

The present invention discloses a driving method for driving a display. The display includes a scan driving circuit, a data driving circuit, a plurality of first signal lines coupling with the scan driving circuit, and a plurality of second signal lines coupling with the data driving circuit. The first signal lines cross the second signal lines to form the pixel matrix. The driving method comprises to divide the pixel matrix into at least a first region and a second region, then, to drive the first region by a first frame rate, and to drive the second region by a second frame rate, wherein the first frame rate is less than the second frame rate. The average power of driving the first region by the first frame rate is less than the average power of driving the second region by the second first frame rate.

In an embodiment, the driving method further comprises to receive a first image data and a second image data, then, to compare the first image data with the second image data to get an image mode, and to divide the pixel matrix into at least the first region and the second region according to the image mode.

In an embodiment, the driving method further comprises a timing controller to control the scan driving circuit and the data driving circuit to drive at least the first region and the second region, wherein when the scan driving circuit drive the first region by the first frame rate, the timing controller generates a first switch signal to the scan driving circuit, and when the scan driving circuit drive the second region by the second frame rate, the timing controller generates a second switch signal to the scan driving circuit.

In an embodiment, the output signal of the data driving circuit is a data signal, an opening state signal, a floating state signal or a high impedance state signal. When a region in the pixel region is not scanned by the scan driving circuit, the output signal of the data driving circuit transferred to the region is an opening state signal, a floating state signal or a high impedance state signal.

In an embodiment, the display is a electrophoresis display, a electrowetting display, a silicon micro display, a MEMS display, an active matrix display, an AMOLED display or a semiconductor silicon display.

The present invention also discloses a display. The display comprises a scan driving circuit, a data driving circuit, a determination unit, a timing controller, a register, a switch circuit, a plurality of first signal lines coupling with the scan driving circuit, a plurality of second signal lines coupling with the data driving circuit. The first signal lines cross the second signal lines to form a pixel matrix. When the pixel region is divided into at least a first region and a second region, the register stores addresses of the first region, the timing controller controls the scan driving circuit and the data driving circuit to drive at least the first region by a first frame rate and the second region by a second frame rate, wherein the first frame rate is less than the second frame rate.

In an embodiment, the determination unit receives a first image data and a second image data. The determination unit compares the first image data with the second image data to get an image mode. The determination unit divides the pixel matrix into at least the first region and the second region according to the image mode.

In an embodiment, the determination unit further comprises a first register to store the first image data and a second register to store the second image data. The first image data is comparing with the second image data to get the image mode.

In an embodiment, when the scan driving circuit drives the first region by the first frame rate, the timing controller generates a first switch signal to the scan driving circuit, and when the scan driving circuit drive the second region by the second frame rate, the timing controller generates a second switch. signal to the scan driving circuit.

In an embodiment, when a region in the pixel region is not scanned by the scan driving circuit, the output signal of the data driving circuit transferred to the region is an opening state signal, a floating state signal or a high impedance state signal.

In an embodiment, the display is a electrophoresis display, a electrowetting display, a silicon micro display, a MEMS display, an active matrix display, an AMOLED display or a semiconductor silicon display.

Accordingly, when a continuous image shown in a display includes a static region or a slow motion region, for reducing the power consumption, the scan driving circuit will reduce the scan frequency (frame rate) in the static region or slow motion region. Moreover, the data driving circuit will not transfer any gray level voltage data to the static region or the slow motion region when the static region or the slow motion region is not scanned by the scan driving circuit.

BRIEF DESCRIPTION OF THE DRAWINGS

In order to make the foregoing as well as other aspects, features, advantages, and embodiments of the present disclosure more apparent, the accompanying drawings are described as follows.

DETAILED DESCRIPTION

Figure 1:
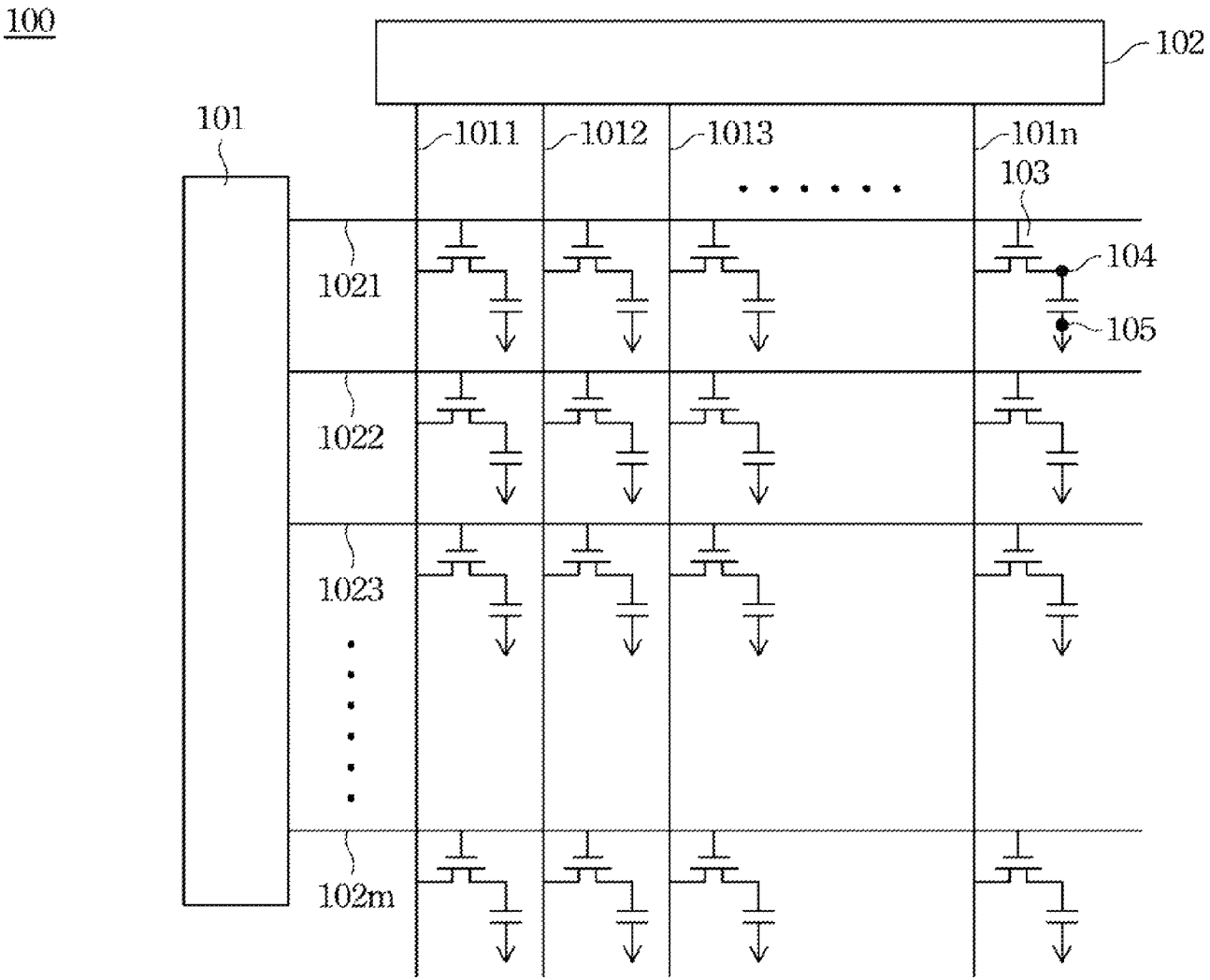
Fig. 1 (PRIOR ART)
FIG. 1 is a schematic diagram of a typical thin film transistor liquid crystal display.
Figure 2:
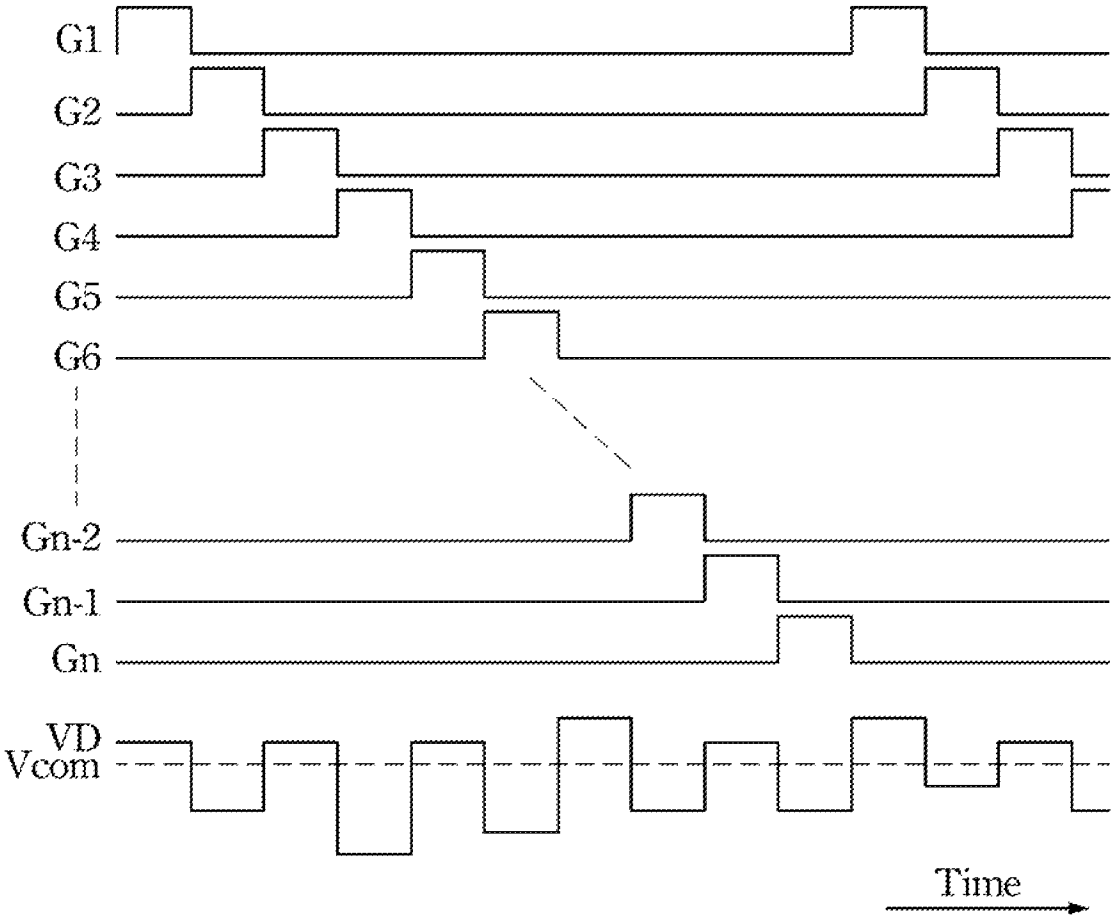
Fig. 2 (PRIOR ART)
FIG. 2 is a schematic diagram of a waveform for driving a typical thin film transistor liquid crystal display.

Reference will now be made in detail to the present embodiments of the disclosure, examples of which are illustrated in the accompanying drawings. Wherever possible, the same reference numbers are used in the drawings and the description to refer to the same or like parts.

According to the driving method of the present invention, when a continuous image shown in a display includes a static region or a slow motion region, for reducing the power consumption, the scan driving circuit will reduce the scan frequency (frame rate) in the static region or slow motion region, and the data driving circuit will not transfer any gray level voltages to the static region or the slow motion region. Therefore, the driving voltage supplied to the scan driving circuit and the data driving circuit may be reduced or be stopped, thereby to reduce the total power consumption of a display. In other words, in the claimed invention, a threshold value is used to divided a continuous image shown in a display into a static region (or a slow motion region) and a dynamic region. The scan driving circuit uses different frame rates to drive the static region (or a slow motion region) and the dynamic region. The data driving circuit supplies corresponding gray level to the pixels according to the different frame rates. Accordingly, the total power consumption of the display is reduced.

Figure 3:
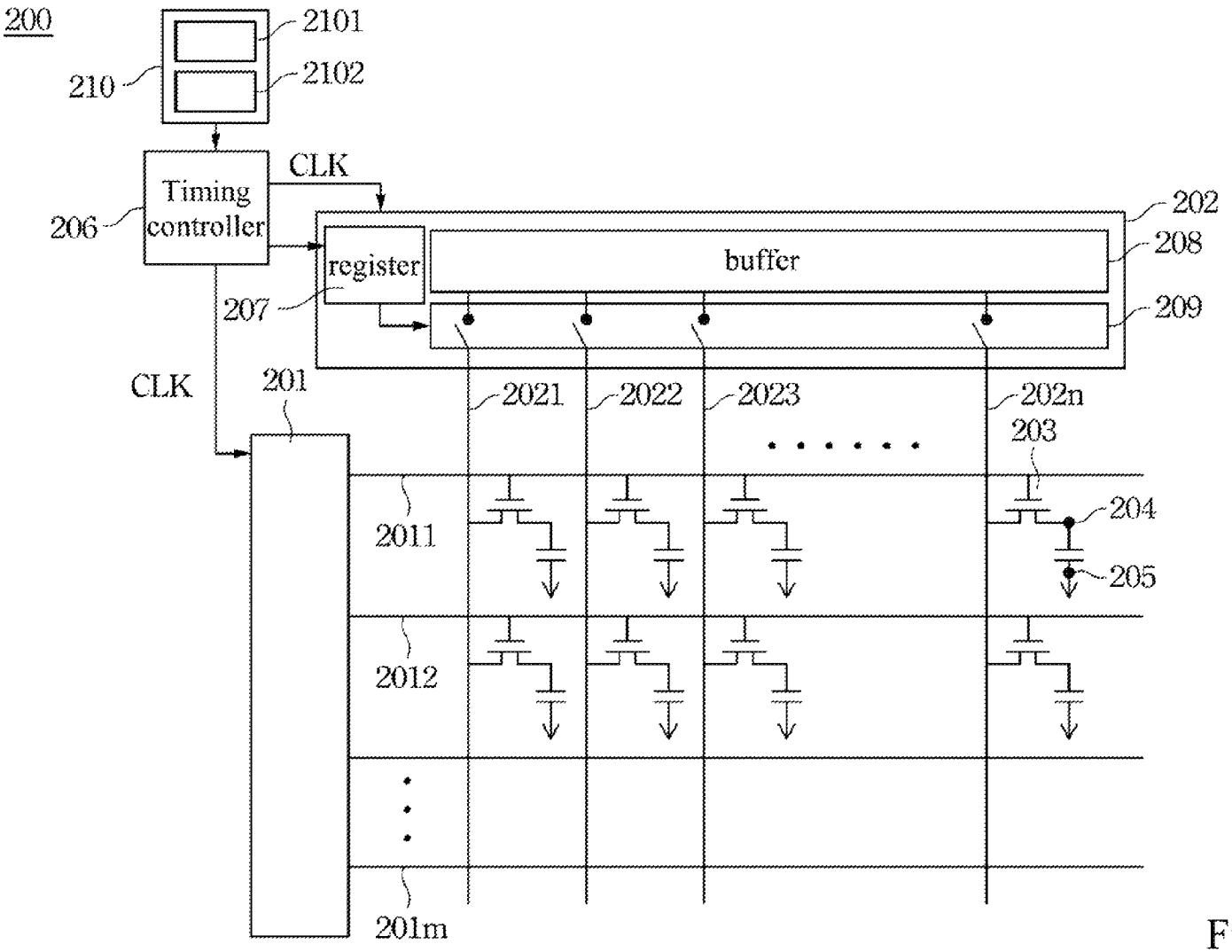
FIG. 3 is a schematic diagram of a thin film transistor liquid crystal display in accordance with an embodiment.

FIG. 3 is a schematic diagram of a thin film transistor liquid crystal display in accordance with an embodiment. The thin film transistor liquid crystal display 200 includes a scan driving circuit 201, a data driving circuit 202, a timing controller 206, a determination unit 210, a plurality of scan lines 2011-201*m*, a plurality of data lines 2021~202*n*, a plurality of thin film transistors 203 and a plurality of pixel electrodes 204. The scan lines 2011-201*m* are arranged in parallel. The data lines 2021~202*n* are also arranged in parallel and cross the scan lines 2011-201*m*. The data lines 2021~202*n* are insulated from the scan lines 2011-201*m*. The thin film transistors 203 are located in the positions that the data lines 2021~202*n* crossing the scan lines 2011-201*m*. The gate electrodes of the thin film transistors 203 are coupled to the scan lines 2011-201*m* respectively. The source electrodes of the thin film transistors 203 are coupled to the data lines 2021~202*n* respectively. The drain electrodes of the thin film transistors 203 are coupled to the pixel electrodes 204 respectively. The common electrodes 205 correspond to the pixel electrodes 204. In an embodiment, the material forming the common electrodes 205 is Indium Tin Oxide (ITO). A pixel unit includes a pixel electrode 124, a common electrode 205 and liquid crystal molecules between the pixel electrode 204 and the common electrode 205. A pixel unit is a minimum display unit in a liquid crystal display 200.

The timing controller 206 transfers the timing signal CLK to the scan driving circuit 201 and the data driving circuit 202. The timing controller 206 also provides an image data to the data driving circuit 202. The data driving circuit 202 generates driving signals to the data lines 2021-202*n* according to the image data and the timing signal CLK. For making sure displaying a correct image by the thin film transistor liquid crystal display, a connection port is used to transfer signals among the timing controller 203, the scan driving circuit 201 and the data driving circuit 202.

Because all the liquid crystal displays, the electrophoresis displays, the electrowetting displays, silicon micro displays belong to a holding type display, the image displayed in the displays may be held. That is, even though the frame rate for forming a continuous static image in a display is reduced, the display quality may not be affected. Therefore, in the claimed invention, the power consumption is much reduced by reducing the frame rate when a continuous static image is shown in a display. Moreover, the invention may be also used in an electrophoresis display, an electrowetting display, a silicon micro display, a MEMS display, an AMOLED display, an active matrix display or a semiconductor silicon display.

Accordingly, the addresses of the static region or the addresses of a region that the data are changed under a special threshold value in a continuous image are marked by the determination unit 210. Then, the timing controller 206 transfers the marked addresses to the scan driving circuit 201. According to the marked addresses, the scan driving circuit 201 reduces the scan frequency (frame rate) while the marked addressed are scanned. On the other hand, the timing controller 206 further transfers the addresses marked by the determination unit 210 to a register 207 in the data driving circuit 202 to control the switch circuit 209. The switch circuit 209 will cut off the connection between the data buffer 208 and the corresponding data lines 2021-202*n* to stop transferring gray level voltage data Vd to data lines when the data buffer 208 transfers gray level voltage data Vd to drive the pixels in the marked addresses. The gray level voltage data Vd is stored in the data buffer 208. In an embodiment, a user can set the frame rate for the marked region. In another embodiment, the static region or slow motion region in a continuous image is decided by the determination unit 201 by comparing the pixel voltages applied to the present image with that of the previous image. According to the comparing result, a corresponding frame rate is also defined. In another embodiment, a transforming table of a display is used to decide the static region or slow motion region in a continuous image. According to the transforming result, a corresponding frame rate is also defined. In further embodiment, the static region or slow motion region in a continuous image is decided by a processor or an operation system. According to the deciding result, a corresponding frame rate is also defined.

The determination unit 201 can determine the static region or slow motion region in a continuous image and transferring the determination result to the timing controller 206 to control the data driving circuit 202 and the scan driving circuit 201. In an embodiment, the determination unit 201 further comprises a first register 2101 and a second register 2102. When a continuous image data, a first image data and a second image data, is transferred to the pixel matrix, the first image data is stored in the first register 2101 and the second image data is stored in the second register 2102. The first image data is compared with the second image data to get an image data mode. According to the image data mode, the determination unit 201 can determine the static region or slow motion region in the continuous image. In other words, the determination unit 201 can at least divide the pixels into two pixel regions, a first pixel region and a second pixel region.

For example, in an embodiment, a static region or a slow motion region in a continuous image is displayed by the pixel region including the scan line 2011 and the scan line 2012. That is, the frame rate in this region is set to reduced, such as from 60 Hz to 3030 Hz. On the other hand, the frame rate of the continuous image displayed by the pixel region including the scan line 2013 to the scan line 201*m* are maintained, such as 60 Hz. Accordingly, when the continuous image is displayed, the scan line 2011 and the scan line 2012 are scanned by 30 Hz by the scan driving circuit 201, and the scan line 2013 to the scan line 201*m* are scanned by 60 Hz by the scan driving circuit 201.

Figure 4:
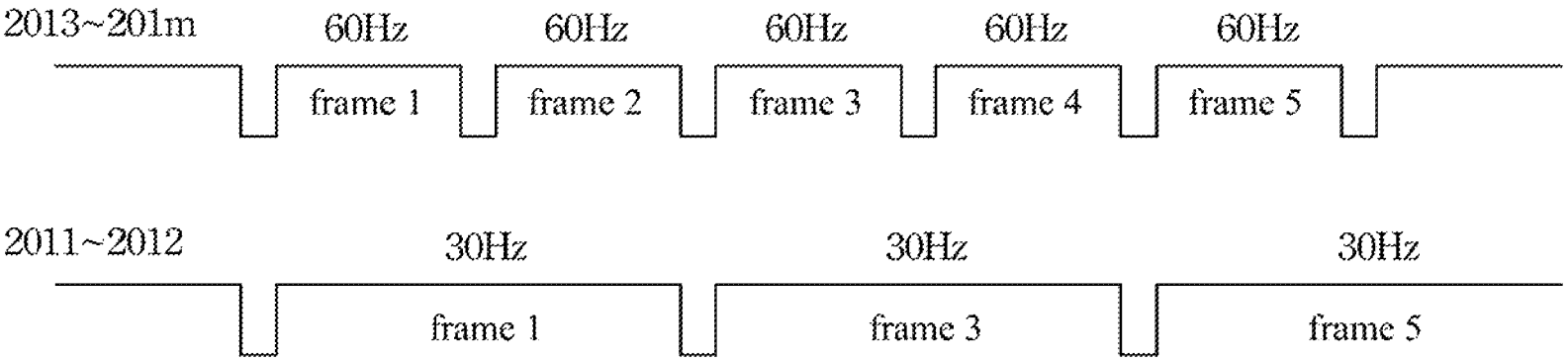
FIG. 4 is a schematic diagram of a frame rate of a thin film transistor liquid crystal display in accordance with an embodiment.

FIG. 4 is a schematic diagram of a frame rate of a thin film transistor liquid crystal display in accordance with an embodiment. The continuous image shown by the pixel region including the scan line 2013 to the scan line 201*m* is displayed by 60 Hz frame rate. The continuous image shown by the pixel region including the scan line 2011 to the scan line 2012 is displayed by 30 Hz frame rate. Therefore, when the continuous image of the frame 1 and frame 2 is displayed by the pixel region including the scan line 2013 to the scan line 201*m*, only the continuous image of the frame 1 is displayed by the pixel region including the scan line 2011 and the scan line 2012. When the continuous image of the frame 3 and frame 4 is displayed by the pixel region including the scan line 2013 to the scan line 201*m*, only the continuous image of the frame 3 is displayed by the pixel region including the scan line 2011 and the scan line 2012. That is, the continuous image of frame 2 does not be displayed by the pixel region including the scan line 2011 and the scan line 2012.

Figure 5:
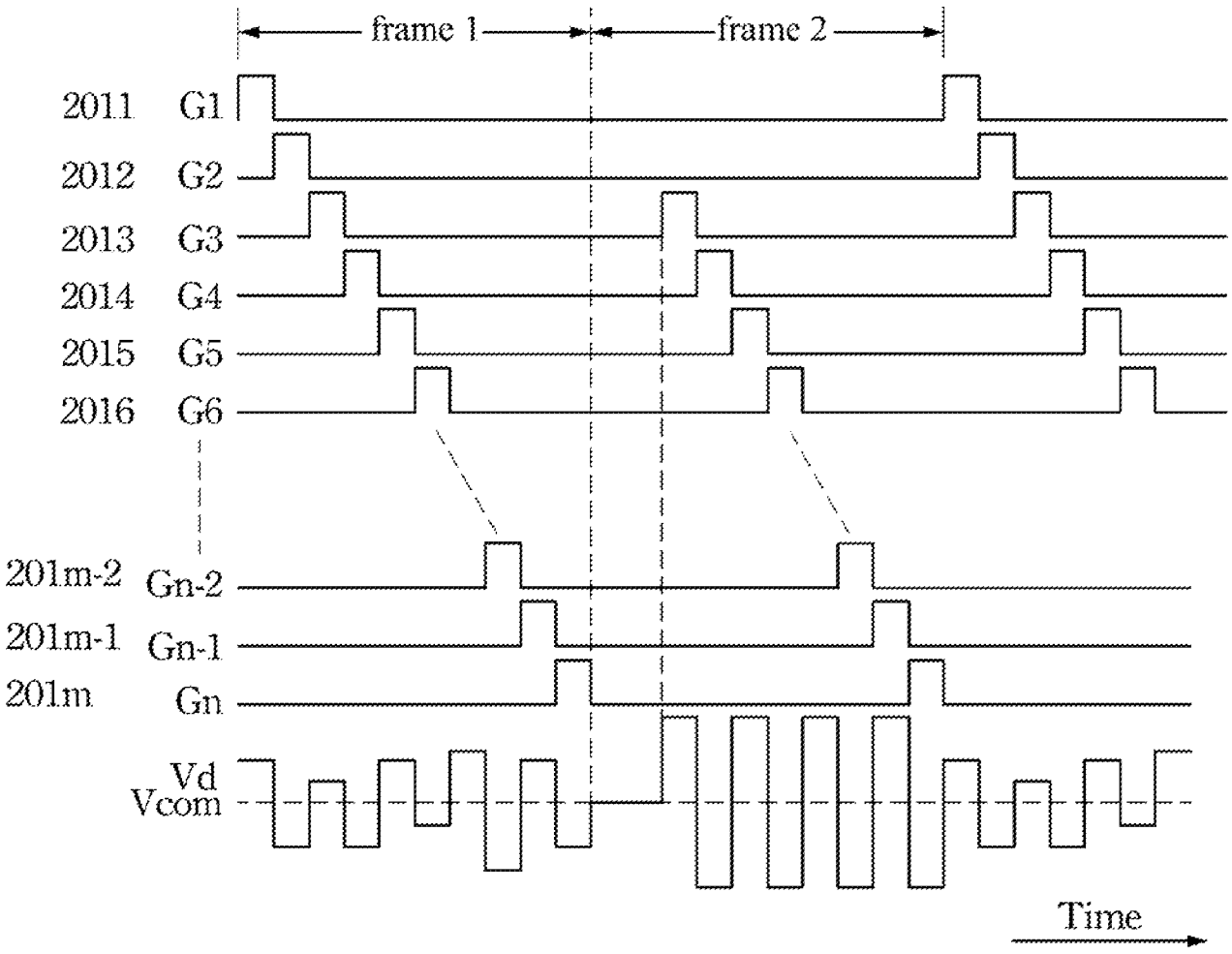
FIG. 5 is a schematic diagram of a waveform for driving the thin film transistor liquid crystal display in accordance with an embodiment.

FIG. 5 is a schematic diagram of a waveform for driving the thin film transistor liquid crystal display in accordance with an embodiment. In frame 2, the scan driving circuit 201 does not provide any scan signal to the scan lines 2011 and the scan line 2012 to display the continuous image. Therefore, the continuous image displayed in frame 1 may be maintained in the pixel region including the scan line 2011 and the scan line 2012 in frame 2. Accordingly, the gray level voltage data for displaying the continuous image of frame 2 does not be transferred to the data lines 2021 to data lines 202*n* in the pixel region including the scan lines 2011 and the scan line 2012. The gray level voltage data of the continuous image of the frame 2 is only transferred to the data lines 2021 to data lines 202*n* in the pixel region including the scan lines 2013 to the scan line 201*n*. That is, the timing controller 206 controls the switch circuit 209 to cut off or to be floating the connection between the data buffer 208 and the data lines 2021-202*n* while the gray level voltage data of the continuous image of frame 2 is transferred to the pixel region including the scan lines 2011 and the scan line 2012. Therefore, the gray level voltage data Vd is not transferred to the data lines 2021-202*n* from data buffer 208. Then, the timing controller 206 controls the switch circuit 209 to connect the data buffer 208 to the data lines 2021-202*n* while the gray level voltage data of the continuous image of frame 2 is transferred to the pixel region including the scan lines 2013 to the scan line 201*m*. Therefore, the gray level voltage data Vd is transferred to the data lines 2021-202*n* from data buffer 208 when pixel region including the scan lines 2013 to the scan line 201*m* is scanned. Accordingly, because the data driving circuit 212 doe not transfer any gray level voltage data Vd to the data lines 2021-202*n* in the pixel region including the scan lines 2011 and the scan line 2012, the power supplied to the data driving circuit 202 can be stopped or reduced. On the other hand, when the scan driving circuit 201 does not provide any scan signal to the scan lines 2011 and the scan line 2012 to display the continuous image in frame 2, the power supplied to the scan driving circuit 201 can be also stopped or reduced.

In an embodiment, the output signal of the data driving circuit 202 includes data signals, floating state signals, open circuit state signals or a high impedance state signals. When the timing controller 206 controls the switch circuit 209 to cut off the connection between the data buffer 208 and the data lines 2021-202*n*, the output signal of the data driving circuit 202 is floating state signals or a high impedance state signals.

In another embodiment, the frame rate of the pixel region including the data line 2021 to the data line 2023 is set to reduce to 30 Hz. The frame rate of the pixel region including the data line 2024 to the data line 202*n* is maintained in 60 Hz. Accordingly, the scan line 2011 to the scan line 201*m* are scanned by the scan driving circuit 201 using 60 Hz. However, the continuous image shown by the pixel region including the data line 2021 to the data line 2023 is displayed by 30 Hz frame rate. The continuous image shown by the pixel region including the data line 2024 to the data line 202*n* is displayed by 60 Hz frame rate. Therefore, when the continuous image of the frame 1 and frame 2 is displayed by the pixel region including the data line 2021 to the data line 2023, only the continuous image of frame 1 is displayed by the pixel region including the data line 2021 to the data line 2023. When the continuous image of frame 3 and frame 4 is displayed by the pixel region including the data line 2024 to the data line 202*n*, only the continuous image of frame 3 is displayed by the pixel region including the data line 2021 to the data line 2023. That is, the continuous image of frame 2 does not be displayed by the pixel region including the data line 2021 to the data line 2023.

That is, the data driving circuit 202 does not provide any gray level voltage data to the data lines 2021-2023 to display the continuous image in frame 2. The gray level voltage data of the continuous image of the frame 2 is only transferred to the data lines 2024 to data lines 202*n*. Therefore, the timing controller 206 controls the switch circuit 209 to connect the data buffer 208 and the data lines 2024-202*n* to transfer the gray level voltage data Vd to the data lines 2024-202*n*. Moreover, the timing controller 206 controls the switch circuit 209 to cut off the continuous between the data buffer 208 and the data lines 2021-2023 to stop transferring the gray level voltage data Vd to the pixel region including the scan lines 2011-2012. Accordingly, because the data driving circuit 202 doe not transfer any gray level voltage data Vd to the data lines 2021-2023, the power supplied to the data driving circuit 202 can be stopped or reduced. In an embodiment, the output signal of the data driving circuit 202 includes data signals, floating state signals or a high impedance state signals. When the timing controller 206 controls the switch circuit 209 to cut off the connection between the data buffer 208 and the data lines 2021-202*n*, the output signal of the data driving circuit 202 is floating state signals or a high impedance state signals.

In further embodiment, the frame rate of the pixel region surrounded by the scan line 2011, the scan line 2012, the data line 2022 and the data line 2023 is set to reduce to 30 Hz. The frame rate of the other pixel region in a display is maintained in 60 Hz. Accordingly, the scan line 2011 to the scan line 201*m* are scanned by the scan driving circuit 201 using 60 Hz. However, the continuous image shown by the pixel region surrounded by the scan line 2011, the scan line 2012, the data line 2022 and the data line 2023 is displayed by 30 Hz frame rate. The continuous image shown by the other pixel region is displayed by 60 Hz frame rate. Therefore, when the continuous image of the frame 1 and frame 2 is displayed by the other pixel region, only the continuous image of frame 1 is displayed by the pixel region surrounded by the scan line 2011, the scan line 2012, the data line 2022 and the data line 2023. When the continuous image of frame 3 and frame 4 is displayed by the other pixel region, only the continuous image of frame 3 is displayed by the pixel region surrounded by the scan line 2011, the scan line 2012, the data line 2022 and the data line 2023. That is, the continuous image of frame 2 does not be displayed by the pixel region surrounded by the scan line 2011, the scan line 2012, the data line 2022 and the data line 2023.

That is, the data driving circuit 202 does not provide any gray level voltage data to the pixel region surrounded by the scan line 2011, the scan line 2012, the data line 2022 and the data One 2023 to display the continuous image in frame 2. The gray level voltage data of the continuous image of the frame 2 is only transferred to the pixels out the region surrounded by the scan line 2011, the scan line 2012, the data line 2022 and the data line 2023. Therefore, the timing controller 206 controls the switch circuit 209 to connect the data buffer 208 and the data line 2021 and data lines 2024-202*n* to transfer the gray level voltage data lid to the data line 2021 and data lines 2024-202*n* while the scan driving circuit 201 scans the scan line 2024-202*n*. Moreover, the timing controller 206 also controls the switch circuit 209 to cut off the continuous between the data buffer 208 and the data lines 2022-2023 to stop transferring the gray level voltage data Vd to the data lines 2022-2023 while the scan driving circuit 201 scans the scan line 2011 and 2012. Accordingly, because the data driving circuit 202 doe not transfer any gray level voltage data Vd to the data lines 2022-2023 while the scan driving circuit 201 scans the scan line 2011 and 2012, the power supplied to the data driving circuit 202 can be stopped or reduced. In an embodiment, the output signal of the data driving circuit 202 includes data signals, floating state signals or a high impedance state signals. When the timing controller 206 controls the switch circuit 209 to cut off the connection between the data buffer 208 and the data lines 2021-202*n*, the output signal of the data driving circuit 202 is floating state signals or a high impedance state signals.

Figure 7:
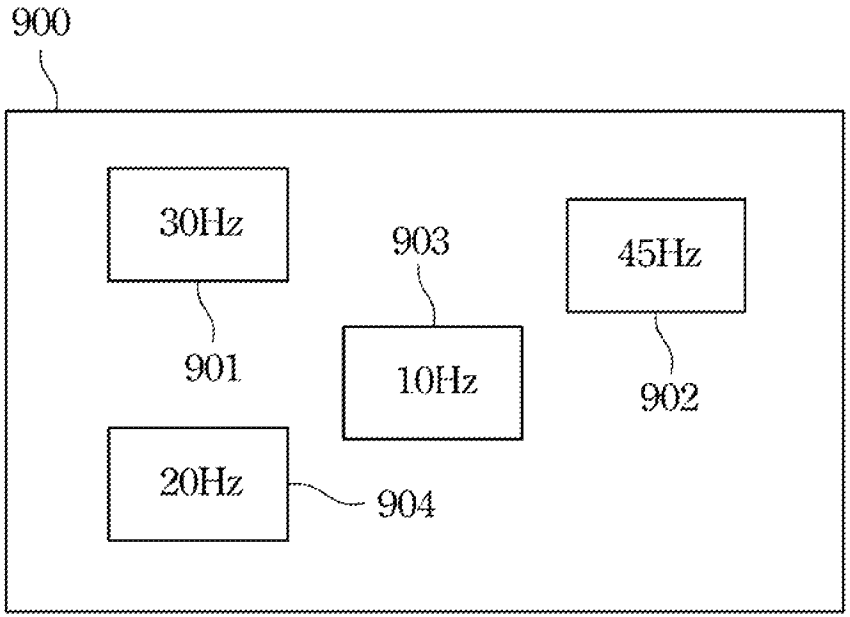
FIG. 7 is a schematic diagram of a display that includes different regions with different frame rates in accordance with an embodiment.

It is noticed that two frame rates, 30 Hz and 60 Hz, are used in the foregoing embodiments to explain the claimed invention. However, the claimed invention method may be also applied to a display to display a continuous image including many frame rates. That is, partial of the continuous image is displayed by different frame rates. For example, seven frame rates are used to display a continuous image. FIG. 7 is a schematic diagram of a display that includes different regions with different frame rates in accordance with an embodiment. The display 900 includes four regions 901, 902, 903 and 904 that are displayed by different frame rates. Region 901 is displayed by 30 Hz frame rate. Region 902 is displayed by 45 Hz frame rate. Region 903 is displayed by 10 Hz frame rate. Region 904 is displayed by 20 Hz frame rate. The other region in the display 900 is displayed by 60 Hz frame rate. In this embodiment, the timing controller 206 controls the scan driving circuit 201 and the data driving circuit 202 to transfer scan signals and gray level voltage data to the display 900. The data driving circuit 202 transfers gray level voltage data to the regions only when the regions are scanned by the scan driving circuit 201. In other words, the data driving circuit 202 does not transfer any gray level voltage data to the regions when the regions are not scanned by the scan driving circuit 201, Therefore, the power consumption of a display can be reduced.

Figure 6:
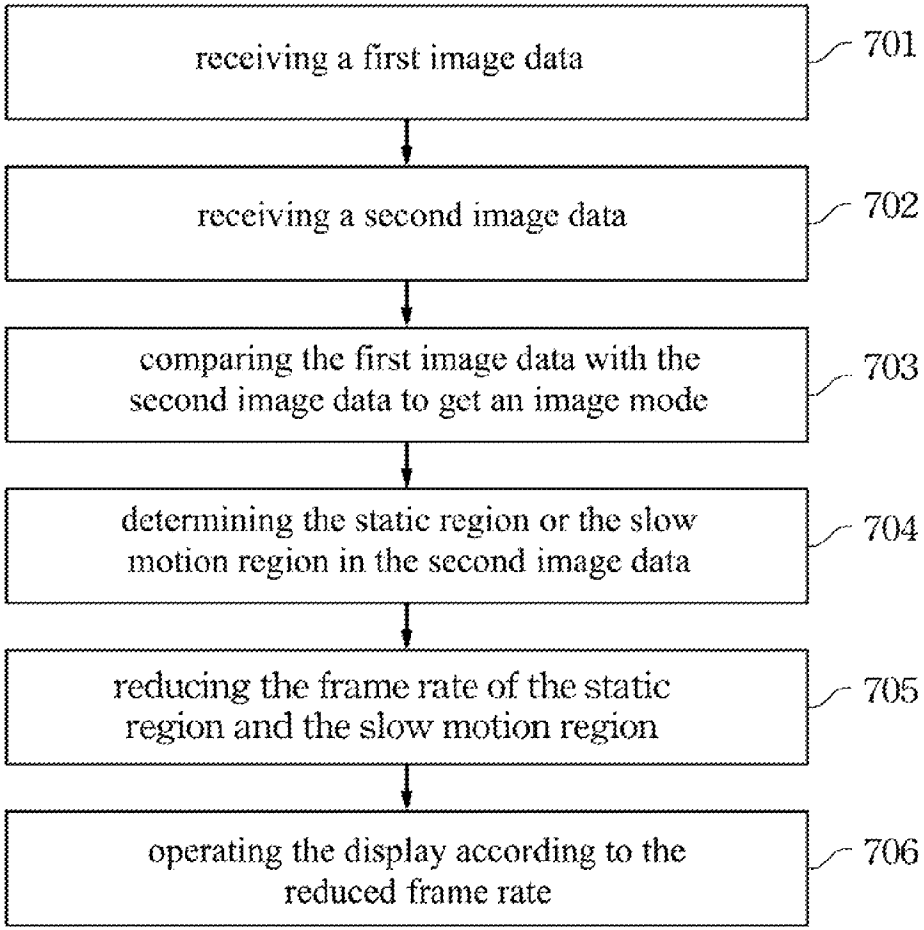
FIG. 6 is a flow chart of dividing a continuous image into a plurality of regions with different frame rates by a determination unit in accordance with an embodiment.

FIG. 6 is a flow chart of dividing a continuous image into a plurality of regions with different frame rates by a determination unit in accordance with an embodiment. However, in another embodiment, a processor or an operation system may also use this flow chart to divide a continuous image into a plurality of regions with different frame rates. In step 701, the determination unit 210 receives a first image data and stores the first image data in the first register 2101. Next, in step 702, the determination unit 210 receives a second image data and stores the second image data in the second register 2101. The second image data follows the first image data to form a continuous image data. The second image data is the present image data. In step 703, the determination unit 210 compares the first image data with the second image data to get an image data mode. In step 704, according to the image data mode, the determination unit 201 determines the static region or slow motion region in the second image data. The addresses of the static region or the slow motion region are stored in the register 207 of the data driving circuit 202. In step 705, the frame rate of the static region or the slow motion region is reduced. Then, in step 706, the display is operated according to the reduced frame rate. At this time, the timing controller 206 controls the scan driving circuit 201 and the data driving circuit 202 to transfer scan signals and gray level voltage data to the pixel region. For example, when a pixel region in a display is defined as a static region or a slow motion region, the timing controller 206 controls the scan driving circuit 201 and the data driving circuit 202 to drive this pixel region by a lower frame rate.

Accordingly, when a continuous image shown in a display includes a static region or a slow motion region, for reducing the power consumption, the scan driving circuit will reduce the scan frequency (frame rate) in the static region or slow motion region. Moreover, the data driving circuit will not transfer any gray level voltage data to the static region or the slow motion region when the static region or the slow motion region is not scanned by the scan driving circuit. The driving method of the present invention may be performed by the timing controller or the driving circuit, the scan driving circuit and the data driving circuit, The driving method of the present invention may be also performed by the timing controller and the driving circuit, the scan driving circuit and the data driving circuit.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A driving method for driving a display, the display includes a scan driving circuit, a data driving circuit, a plurality of first signal lines coupling with the scan driving circuit, and a plurality of second signal lines coupling with the data driving circuit, wherein the first signal lines cross the second signal lines to form the pixel matrix, comprising:

dividing the pixel matrix into at least a first region and a second region, further comprising:

receiving a first image data by a first register;

receiving a second image data following the first image data by a second register;

comparing pixel voltages of the first image data with that of the second image data to get an image mode, wherein addresses of pixels whose pixel voltage change is under a special threshold value are marked in the image mode; and dividing the pixel matrix into at least the first region and the second region according to the image mode;

driving the first region by a first frame rate; and driving the second region by a second frame rate, wherein the first frame rate is less than the second frame rate, and wherein when the scan driving circuit transfers scan signals to the second region but does not transfer scan signals to the first region according to the first frame rate, the data driving circuit transfers data signals to the second region and transfers floating state signals, open circuit state signals or high impedance state signals to the first region to make the pixel matrix to display a frame, wherein in the frame a power supplied to the scan driving circuit and the data driving circuit is continued when the scan driving circuit transfers scan signals to the second region and the data driving circuit transfers data signals to the second region, and the power supplied to the scan driving circuit and the data driving circuit is stopped when the scan driving circuit does not transfer scan signals to the first region and the data driving circuit transfers floating state signals, open circuit state signals or high impedance state signals to the first region.

2. The driving method of claim 1, wherein dividing the pixel matrix into at least the first region and the second region is in accordance with a display transform table.

3. The driving method of claim 1, wherein dividing the pixel matrix into at least the first region and the second region is performed by a processor or an operation system.

4. The driving method of claim 1, wherein when the scan driving circuit drive the first region by the first frame rate, a timing controller generates a first switch signal to the scan driving circuit, and when the scan driving circuit drive the second region by the second frame rate, the timing controller generates a second switch signal to the scan driving circuit.

5. The driving method of claim 1, wherein the average power of driving the first region by the first frame rate is less than the average power of driving the second region by the second first frame rate.

6. The driving method of claim 1, wherein the display is a electrophoresis display, an electrowetting display, a silicon micro display, a MEMS display, an active matrix display or a semiconductor silicon display.

7. A display, comprising:

a scan driving circuit;

a data driving circuit, wherein an output signal of the data driving circuit is a data signal, an open circuit state signal, a floating state signal or a high impedance state signal;

a determination unit;

a timing controller;

a switch circuit;

a plurality of first signal lines coupling with the scan driving circuit;

a plurality of second signal lines coupling with the data driving circuit, wherein the first signal lines cross the second signal lines to form a pixel matrix, wherein a first register receives a first image data and a second register receives a second image data following the first image data, the determination unit compares pixel voltages of the first image data with pixel voltages of the second image data to get an image mode, wherein addresses of pixels whose pixel voltage change is under a special threshold value are marked in the image mode, and to divide the pixel matrix into at least the first region and the second region according to the image mode;

when the pixel matrix is divided into at least the first region and the second region, a third register stores addresses of the first region, the timing controller controls the scan driving circuit and the data driving circuit to drive at least the first region by a first frame rate and the second region by a second frame rate, wherein the first frame rate is less than the second frame rate, and wherein when the scan driving circuit transfer scan signals to the second region but does not transfer scan signals to the first region according to the first frame rate, the data driving circuit transfers data signals to the second region and transfers floating state signals, open circuit state signals or high impedance state signals to the first region to make the pixel matrix to display a frame of an image, wherein the frame, a power supplied to the scan driving circuit and the data driving circuit is continued when the scan driving circuit transfers scan signals to the second region and the data driving circuit transfers data signals to the second region, and the power supplied to the scan driving circuit and the data driving circuit is stopped when the scan driving circuit does not transfer scan signals to the first region and the data driving circuit transfers floating state signals, open circuit state signals or high impedance state signals to the first region.

8. The display of claim 7, further comprising a display transform table, wherein the pixel matrix is divided into at least the first region and the second region in accordance with the display transform table.

9. The display of claim 7, further comprising a processor and an operation system, the processor or the operation system divides the pixel matrix into at least the first region and the second region.

10. The display of claim 7, wherein when the scan driving circuit drive the first region by the first frame rate, the timing controller generates a first switch signal to the scan driving circuit, and when the scan driving circuit drive the second region by the second frame rate, the timing controller generates a second switch signal to the scan driving circuit.

11. The display of claim 7, wherein the display is a electrophoresis display, an electrowetting display, a silicon micro display, a MEMS display, an active matrix display or a semiconductor silicon display, an AMOLED display.

* * * * *